United States Patent [19]

Lee et al.

[11] Patent Number: 4,932,897

[45] Date of Patent: Jun. 12, 1990

[54] CONNECTOR FOR AN ELECTRICAL SIGNAL TRANSMITTING CABLE

[76] Inventors: Noel Lee, 47 W. Park Dr., Daly City, Calif. 94015; James D. Hassi, 3619 21st St., San Francisco, Calif. 94114

[21] Appl. No.: 293,949

[22] Filed: Jan. 5, 1989

[51] Int. Cl.[5] ..... H01R 17/18

[52] U.S. Cl. ..... 439/578; 439/675; 439/851

[58] Field of Search ..... 439/851, 858, 578, 585, 439/842, 675, 668, 848

[56] References Cited

U.S. PATENT DOCUMENTS

| | | | |
|---|---|---|---|
| 3,340,495 | 9/1967 | Weinschel | 439/578 |
| 3,437,982 | 4/1969 | O'Keefe et al. | 439/578 |
| 3,845,453 | 10/1974 | Hemmer | 439/578 |
| 3,966,292 | 6/1976 | Schultz | 439/578 |
| 4,249,790 | 2/1981 | Ito et al. | 439/583 |
| 4,447,108 | 5/1984 | Ghigliotti et al. | 439/851 |
| 4,561,716 | 12/1985 | Acke | 439/851 |

*Primary Examiner*—David L. Pirlot
*Attorney, Agent, or Firm*—Warren B. Kice

[57] ABSTRACT

A connector for connecting an electrical signal transmitting cable to a corresponding jack and including a cylindrical base member having an end for receiving the cable. A sleeve forms an extension of the other end of the base member and is adapted to engage over a corresponding flange of the jack. The sleeve is formed by a plurality of angled segments. A pin projects from the second end and is adapted to extend in a corresponding socket of the jack.

8 Claims, 1 Drawing Sheet

CONNECTOR FOR AN ELECTRICAL SIGNAL TRANSMITTING CABLE

BACKGROUND OF THE INVENTION

This invention relates to a connector and, more particularly, to a connector for connecting an electrical signal transmitting cable to a corresponding jack of an electronic component.

The most common connector utilized for connecting electronic components, such as those used in home audio and video systems, utilize what is commonly referred to as a "RCA" connector which consists of a cylindrical member adapted for connection at one end to a cable and having a pin and a contact, or ground, sleeve projecting from the other end. The pin engages in a corresponding socket in a terminal, or jack, to form the "positive" connection, and the contact sleeve extends over a cylindrical flange of the jack in an interference fit to form the "negative", or ground, connection. As a result, current can flow to the component from a component connected to the other end of the cable. However, the typical RCA connector has several shortcomings. For example, the contact sleeve of the connector is not fabricated to close tolerances and often is too large in size and/or is "out-of-round". This considerably reduces the contact area between it and the flange on the jack, resulting in a relatively loose connection with the flange and poor current transfer. Also, since the contact sleeve is fabricated of a relatively thin material, it tends to bend and fatigue with use which compounds the above problems.

SUMMARY OF THE INVENTION

It is therefore an object of the present invention to provide an improved connector for connecting an electrical signal transmitting cable to a corresponding jack which overcomes the aforementioned problems.

It is a still further object of the present invention to provide a connector of the above type which has a lower contact resistance and a greater contact area and mass and permits a greater transfer of current when compared to prior art advices.

It is a further object of the present invention to provide a connector of the above type which features an improved sleeve which provides a greater and more positive contact with the corresponding flange of the jack.

It is a still further object of the present invention to provide a connector of the above type which does not deform, weaken or loosen with use.

Toward the fulfillment of these and other objects the connector of the present invention comprises a cylindrical member having a pin projecting from one end and adapted to extend in a corresponding socket of a jack. A contact sleeve forms an extension of the latter end and is adapted to engage over a corresponding flange of the jack. The sleeve is tapered towards its end and has a plurality of slots formed therein to divide the sleeve into a plurality of segments. The slots extend at an angle to the axis of the sleeve to increase the size of the segments and the contact area with the flange of the jack. The segments are relatively thick so that they will maintain a compressive force when in engagement with the flange of the jack.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance wit the present invention when taken in conjunction with the accompanying drawings wherein.

DESCRIPTION OF PREFERRED EMBODIMENT

Figure 1:
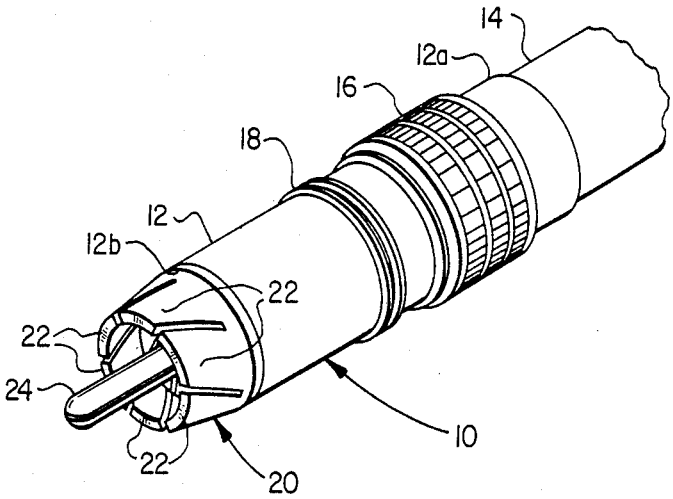
FIG. 1 is a perspective view of the connector of the present invention.

Referring specifically to the drawings, the reference numeral 10 refers, in general to the connector of the present invention which includes a cylindrical barrel 12 having two open ends, 12*a* and 12*b*. A cable assembly 14 extends within the end 12*a* and includes two conductors (not shown) electrically connected to internal terminals provided in the barrel 12. The latter terminals are not shown in the drawings but are described in detail in applicant s co-pending U.S. Patent Application Ser. No. 042332 the disclosure of which is hereby incorporated by reference.

A raised knurled ring segment 16 is formed on the outer surface of the barrel for facilitating gripping of the connector, and a ring 18 is also provided on the barrel which may be color coded to identify the connector.

Figure 2:
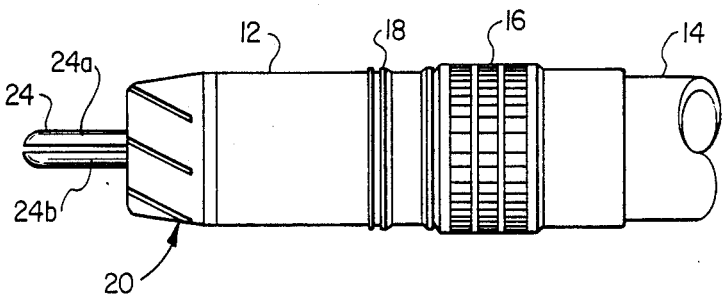
FIG. 2 is a side elevational view of the connector of FIG. 1.
Figure 3:
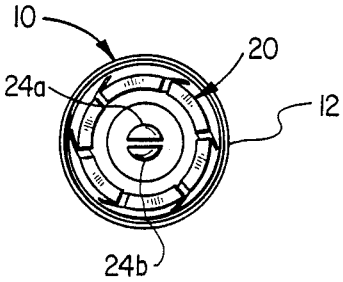
FIG. 3 is a front end view of the connector of FIGS. 1 and 2.

A sleeve, shown in general by the reference numeral 20, is formed integrally with the end 12*b* of the barrel 12 and comprises six individual segments 22 formed by cutting six slots 23 in the sleeve. Each slot 23 extends from the distal end of said sleeve 20 towards the barrel 12 and at an angle to imaginary line running through the sleeve and parallel to the axis of the sleeve. After the slots 23 are cut the distal end positions of the segments 22 are bent slightly radially inwardly so that the sleeve is tapered slightly towards its end as better shown in FIG. 2.

A pin 24, formed by two parallel split portions 24*a* and 24*b*, extends from the barrel 12 and its end portion projects from the sleeve 20. It is understood that, internally of the barrel 12, the pin 24 and the sleeve 20 are electrically connected to the aforementioned terminals in the barrel 12, and therefore to the two conductors of the cable assembly 14.

In operation, the connector 10 is advanced toward the jack until the pin 24 enters the socket of the jack. The connector is then pushed into the jack causing the pin to advance further into the jack and the sleeve 20 to extend over the flange of the jack in an interference fit. This continues until the pin 24 "bottoms out" in the socket and the flange extends completely within the sleeve 20. Current can then flow from one conductor in the cable assembly 14, through an internal terminal, the pin 24, the socket and to the component connected to the jack; and back through the flange, the sleeve 20, the other internal terminal, and to the other conductor of the cable assembly 14.

The connector 10 of the present invention has several advantages. For example, the resiliency of the pin 24 made possible by the two split portions 24*a* and 24*b* insures a positive contact with the socket of the jack. Also, the inner diameter cf the tapered end portion of the sleeve 20 is sized so that it is slightly less than the outer diameter of the flange of the jack so that the segments will flex, or expand, slightly radially outwardly upon engagement in an interference fit with the flange. Further, since the slots 23 enable the segments 22 to be fabricated of a relatively large thickness, relatively high compressive forces are exerted on the flange to maintain a positive interference fit. Also, the angled slots 23 enable the length of each individual segment 22 to be greater than the length if the slots were straight, i.e., parallel with an imaginary line running through the sleeve 20 and parallel with the axis of the sleeve. Thus, the contact area between each segment 22 and the flange is relatively high.

This increased compression made possible by the relatively large mass over a relative large contact area lowers the contact resistant and results in a greater or more positive contact with the flange and an improved current transfer. Also, the sleeve 22 will not bend or fatigue with age or use so that the increased compression is maintained.

It is understood that the present invention is not limited to use with an RCA connector and jack but is applicable to any connector-jack arrangement in which a sleeve extends over a flange.

A latitude of modification, change and substitution is intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A connector for connecting an electrical signal transmitting cable to a corresponding jack, said connector comprising a cylindrical base member having one end adapted to receive said cable; a sleeve extending from the other end of said base member, said sleeve being frusto-conical, having a central axis and adapted to engage over a corresponding flange of said jack; and a plurality of slots formed in said sleeve to form a plurality of segments, each of said slots extending from the distal end of said sleeve towards said base member and at an oblique angle to any plane containing said central axis.

2. The connector of claim 1 wherein each of said slots has a constant width throughout its length.

3. The connector of claim 1 wherein the inner surface of each segment contacts the corresponding outer surface of said flange along a substantial portion of the length of each segment.

4. The connector of claim 1 further comprising a pin projecting from said sleeve and adapted to extend in a corresponding socket of said jack.

5. The connector of claim 1 wherein said segments are longer in length and thus have a greater contact area with the corresponding surface of said flange than they would be if said slots were parallel to the axis of said sleeve.

6. The connector of claim 1 wherein the thickness of walls of said sleeve are sufficient to exert a relatively high compressive force on said flange sufficient to prevent flexing of said sleeve in the absence of said slots, said slots permitting said segments to flex radially outwardly upon engagement with said flange.

7. The connector of claim 1 wherein the ends of said segment are bent radially inwardly to form said frusto-cone and to engage said flange in an interference fit.

8. The connector of claim 7 wherein said segment ends are bent to the extent that the inner diameter of said end of said sleeve is slightly less than the outer diameter of said flange so that said segments flex radially outwardly when engaging said flange in said interference fit.

* * * * *